US005607360A

United States Patent [19]

Shiffman

[11] Patent Number: 5,607,360

[45] Date of Patent: Mar. 4, 1997

[54] GOLF PUTTING GAME APPARATUS

[76] Inventor: Jack Shiffman, 213 Copland Crescent, Saskatoon, Saskatchewan, Canada, S7H 2Z4

[21] Appl. No.: 515,037

[22] Filed: Aug. 14, 1995

[51] Int. Cl.[6] ..... A63B 69/36

[52] U.S. Cl. ..... 473/180

[58] Field of Search ..... 273/177 R, 177 A, 273/177 B, 184 A, 185 R; 473/152, 180, 185

[56] References Cited

U.S. PATENT DOCUMENTS

| | | | |
|---|---|---|---|
| 1,319,561 | 10/1919 | Brenner | 273/272 |
| 1,338,963 | 5/1920 | Rolfe | 273/177 A X |
| 3,584,877 | 6/1971 | Florian | 273/184 A |
| 3,949,987 | 4/1976 | Candor | 273/176 L |
| 4,505,478 | 3/1985 | Riethmiller | 273/32 H |
| 4,743,026 | 5/1988 | Eady | 273/176 L |
| 5,020,802 | 6/1991 | Strom | 273/185 R |
| 5,261,670 | 11/1993 | Mull | 273/177 R X |

FOREIGN PATENT DOCUMENTS

| | | | |
|---|---|---|---|
| 2073598 | 10/1981 | United Kingdom | 273/184 A |

*Primary Examiner*—George J. Marlo

[57] ABSTRACT

The present invention provides a golf putting game apparatus for improving a player's putting skills. The golf putting game apparatus allows the player to practice putting accurately and to practice putting the ball with the correct amount of force. A scoring method for measuring the player's relative proficiency is provided. The golf putting game apparatus comprises a scoring template with opposite front and rear edges for arrangement on a putting surface such as a suitable carpet material, a putting green, or other surface suitable for putting. The scoring template includes hole marking means for marking on the putting surface a circular zone which represents a hole on a golf green, holed-out zone marking means for marking on the putting surface an elongate holed-out zone extending from the circular zone to the rear edge of the template, and scoring zone marking means for marking on the putting surface a pattern of spaced apart lines. The scoring zone marking means are spaced from and extend outwards from the circular zone to the edges of the template. A golf ball putt onto the template from in front of the template with the correct line and weight to enter a hole in a golf green will come to rest on the circular zone or holed-out zone. This allows the golfer to develop a feel for putting with the correct weight as well as line. A score is calculated by adding scoring indices marked on the template which lie adjacent the location at which the ball comes to rest.

6 Claims, 2 Drawing Sheets

GOLF PUTTING GAME APPARATUS

FIELD OF THE INVENTION

The present invention provides a golf putting game apparatus for use in improving a players putting skills.

BACKGROUND

The game of golf is designed to allow an expert golfer one, two or three strokes to get on the putting green depending on whether the hole is Par 3, Par 4 or Par 5 respectively. Once the ball is on the putting green, the expert golfer is allowed two putts for Par. Since Par for a round of golf is usually seventy-two strokes for eighteen holes this allows thirty-six strokes plus thirty-six putts for the expert golfer to play the round at Par.

Therefore putting may be considered one half of the scoring in golf and a player's golf score may be improved significantly by improving the player's putting skills. To accomplish this, a player must develop accuracy and a 'feel' for the distance from the golf ball to the hole.

A golf putting game apparatus for use while practicing putting, either as part of playing a game or as part of a golf lesson, is needed which allows the player to practice putting accurately, to practice putting the ball with the correct amount of force to make it to the hole, and which provides a scoring method for measuring the player's proficiency.

SUMMARY

According to the present invention there is provided a golf putting game apparatus comprising:

a putting surface;

a scoring template arranged on the putting surface including:

a circular zone, said circular zone representing a hole on a golf green;

an elongate holed-out zone extending from the circular zone towards an edge of the template;

a plurality of spaced apart lines in a pattern, said pattern being spaced from and extending outwards from the circular zone;

a plurality of scoring indices indicating scores associated with respective ones of the plurality of spaced apart lines.

The scoring template may be placed on any suitable putting surface and includes a circular outline defining the circular zone. A plurality of elongate first scoring zones extend outwards from the circular zone towards respective sides of the scoring template, and a plurality of second scoring zones lie between respective pairs of adjacent first scoring zones.

According to a second aspect of the invention there is provided a method of playing a golf game comprising:

providing a scoring template on a putting surface, said scoring template including:

a circular zone, said circular zone being defined by a circular outline and representing a hole on a golf green;

a plurality of spaced apart lines in a pattern being spaced from and extending outwards from the circular outline wherein the pattern includes a plurality of elongate first scoring zones extending outwards from the circular outline towards respective sides of the pattern and comprising a holed-out zone extending towards a rear side of the pattern, an in-line zone extending towards a front side of the pattern and being aligned with the holed-out zone, a first pin-high zone extending towards a right side of the pattern, and a second pin-high zone extending towards a left side of the pattern and being aligned with the first pin-high zone, and wherein the pattern includes a plurality of second scoring zones lying between respective pairs of adjacent first scoring zones with the plurality of spaced apart lines of each one of the second scoring zones being arranged in a grid of intersecting lines;

a plurality of scoring indices each indicia being a number indicating a score associated with respective ones of the plurality of spaced apart lines;

putting a golf ball onto the scoring template from a position in front of the template;

obtaining a current score when the golf ball comes to rest on the circular zone or the holed-out zone, by adding a number associated with a respective one of said zones to a previous score;

obtaining a current score when the golf ball comes to rest on the in-line zone by adding a number indicated by a respective scoring indicia associated with a line lying adjacent the golf ball to the previous score;

obtaining a current score when the golf ball comes to rest on the first and second pin-high zones, by adding a number indicated by a respective scoring indicia associated with a line lying adjacent the golf ball to the previous score;

obtaining a current score when the golf ball comes to rest on one of the plurality of second scoring zones by adding numbers indicated by respective scoring indices associated with each of two intersecting lines lying adjacent the golf ball to the previous score.

An embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
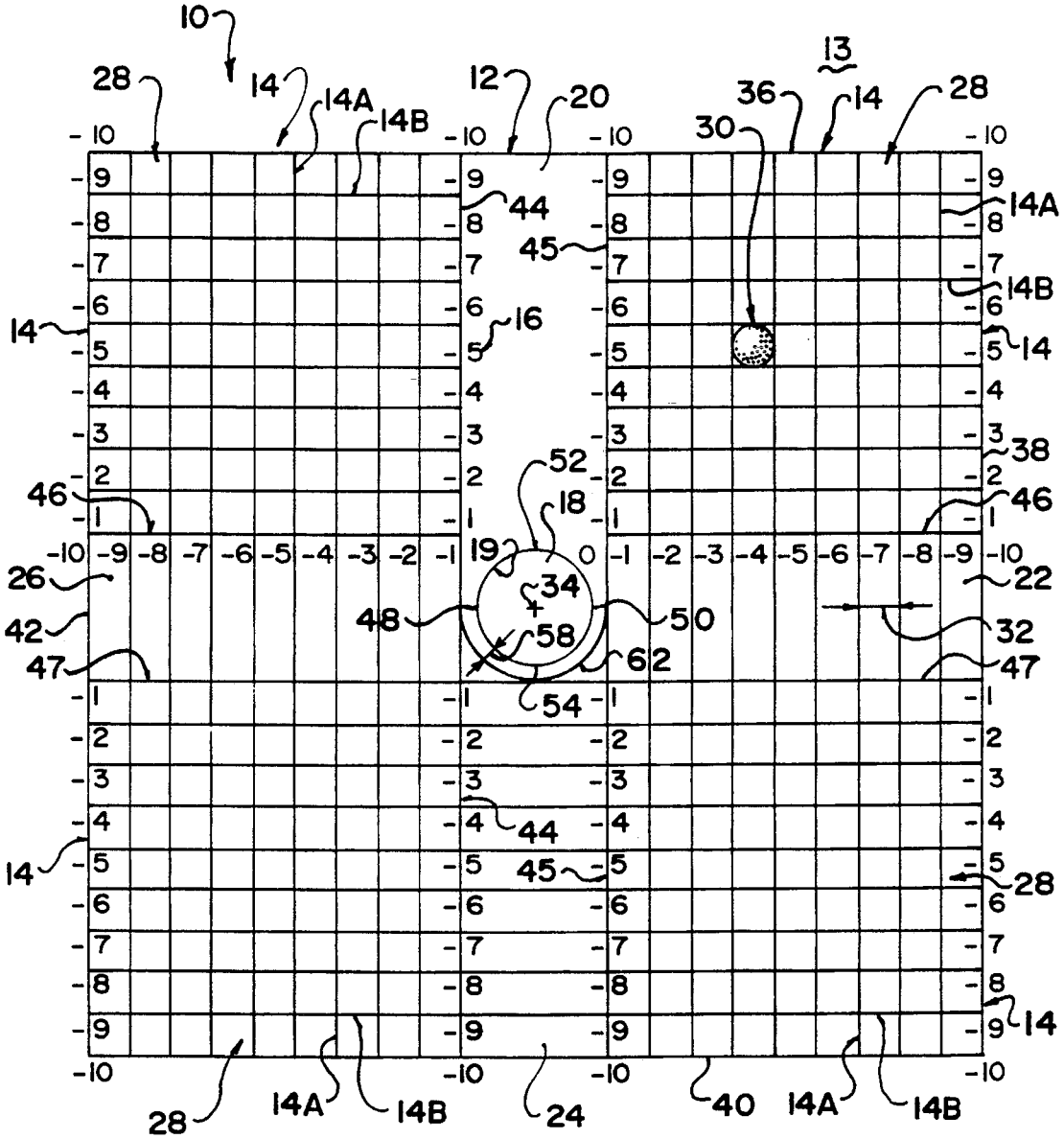
FIG. 1 is a top view of the scoring template.
Figure 3:
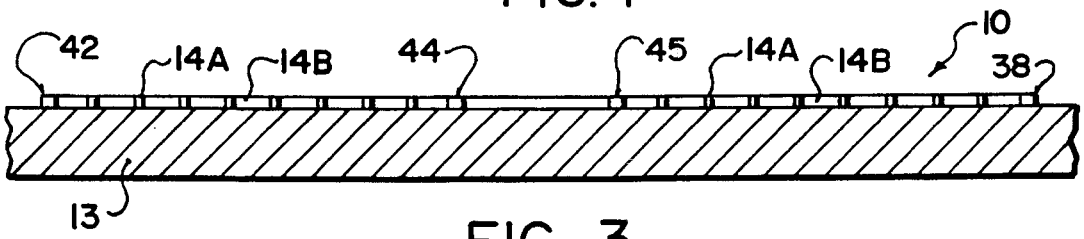
FIG. 3 is a front elevation of the template on a putting surface.
Figure 2:
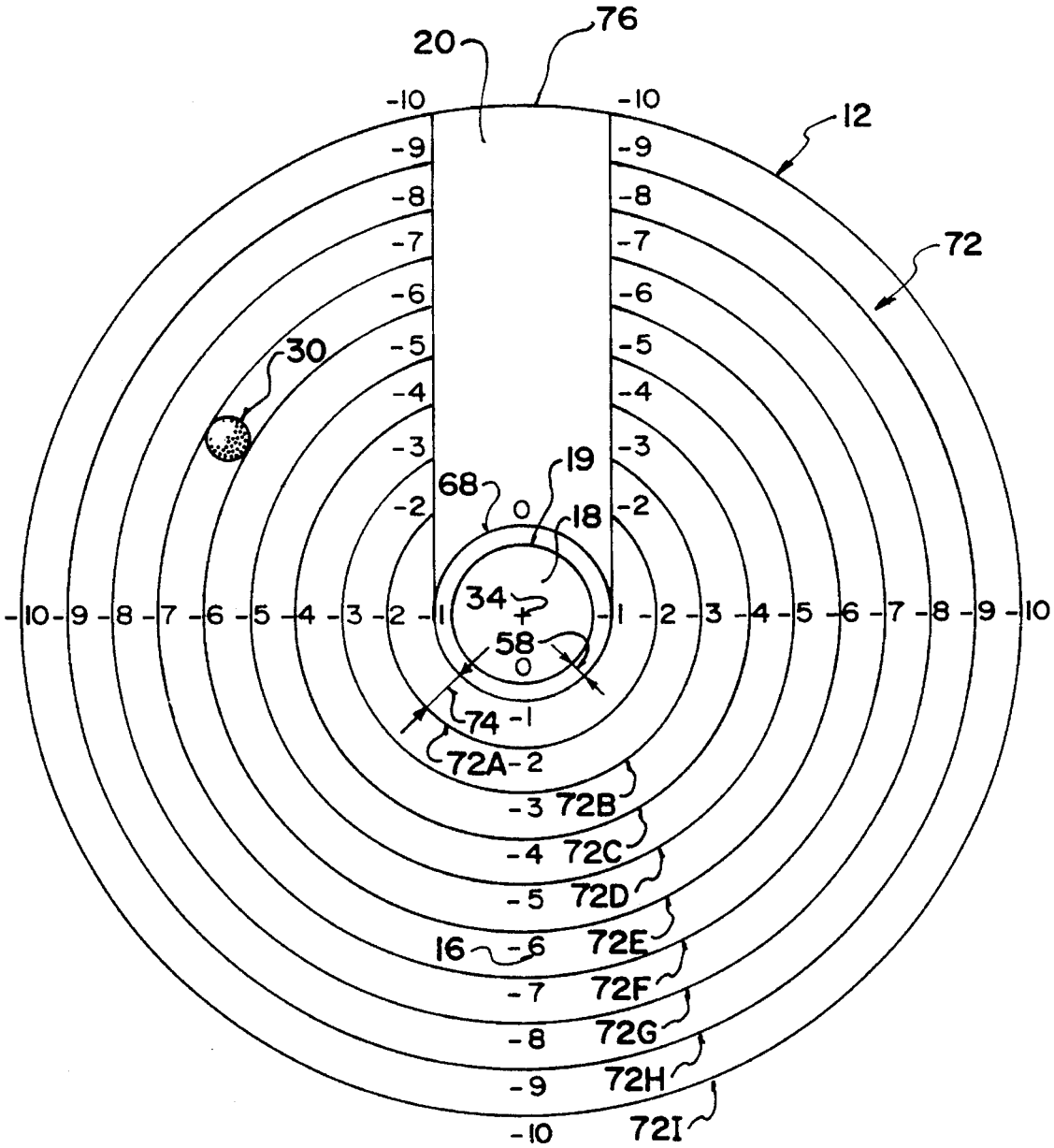
FIG. 2 is a top view of the alternative circular scoring template.

Referring to FIG. 1 a preferred embodiment of the golf putting game apparatus is shown generally at 10. The golf putting game apparatus comprises a scoring template 12 arranged on a putting surface 13 such as a suitable carpet material, a putting green, or other surface suitable for putting. The scoring template 12 includes a circular zone 18, a plurality of spaced apart lines 14 and a plurality of scoring indices 16, said plurality of spaced apart lines 14 are arranged in a rectangular pattern defining a number of scoring zones including a plurality of elongate first scoring zones 20, 22, 24, and 26, and a plurality of second scoring zones 28.

The scoring template 12 is made of a transportable material such as ribbon, thread, string or a like material designed to be placed or fastened to a suitable putting surface 13 to mark zones on the surface. The material is chosen such that it will minimally effect the distance or direction of travel of a golf ball 30 which is rolled or putted onto or over it. The scoring template 12 provides a playing surface 916.06 mm (36 inches) square and is divided by the plurality of spaced apart lines 14 arranged in a rectangular grid pattern. The plurality of spaced apart lines 14 comprise lines 14*a* extending from the front of the scoring template to the rear of the template and lines 14*b* extending from the left side of the template to the right side. Each one of the plurality of lines 14 is spaced a distance 32 from the adjacent lines, said distance 32 is equal to the diameter of a U.S.G.A. approved golf ball (42.67 mm). The circular zone 18 represents a hole on a golf green and is centered on the geometric centre 34 of the scoring template 12. The circular zone 18 typically measures 108 mm in diameter and is defined by a circular outline 19.

The first scoring zones are arranged such that the holed-out zone 20 extends to the rear side 36 of the pattern, the in-line zone 24 extends towards the front side 40 of the pattern, the first pin-high zone 22 extends towards the right side 38 of the pattern, and the second pin-high zone 26 extends towards the left side 42 of the pattern. Furthermore the in-line zone 24 is aligned with the holed-out zone 20, and the second pin-high zone 26 is aligned with the first pin-high zone 22.

Each of the second scoring zones 28 lies between a respective pair of adjacent first scoring zones.

The plurality of spaced apart lines defining the first and second scoring zones include ten front to back parallel lines 14*a* on each of the right and left sides of the circular outline 19. Each one of the front to back lines 14*a* are 916.06 mm long and extend from the front 40 of the scoring template 12 to the rear 36 of the scoring template 12. The pair of the front to back parallel lines 44 and 45 lie adjacent opposing sides 48 and 50 of the circular outline 19 and are spaced a distance 58 (20 mm) outwards therefrom. The pair of lines 44 and 45 bound the holed-out and in-line zones 20 and 24 thereby producing a corridor measuring 148 mm in width which passes through the centre 34 of the scoring template 12 from front to back. This corridor separates the ten front to back lines 14*a* on the left side, from the ten front to back lines 14*a* on the right side, and contains the circular zone 18 and the circular outline 19. The front to back lines 14*a* pass through the first and second pin-high zones 22 and 26, and the plurality of second scoring zones 28.

The plurality of spaced apart lines also include ten side to side parallel lines 14*b* arranged to the front and to the rear of the circular outline 19. Each one of the side to side lines 14*b* are 916.06 mm long and extend from the left side 42 of the scoring template 12 to the right side 38 of the scoring template 12. The pair of side to side parallel lines 46 and 47 lie adjacent opposing sides 52 and 54 of the circular outline 19 and are spaced a distance 58 (20 mm) outwards therefrom. The pair of lines 46 and 47 bound the first and second pin-high zones 22 and 26 thereby producing a corridor measuring 148 mm in width which passes through the centre 34 of the scoring template 12 from side to side. This corridor separates the ten side to side lines 14*b* on the front and the rear sides and contains the circular zone 18 and the circular outline 19.

The side to side lines 14*b* which are arranged to the front of the circular outline 19 pass through the in-line zone 24 and a forward two of the plurality of second scoring zones 28. The side to side lines 14*b* which are arranged to the rear of the circular outline 19 pass through a rear two of the plurality of second scoring zones 28, but are discontinuous and do not pass through the holed-out zone 20 leaving it devoid of lines. The outward most side to side line arranged to the rear of the circular outline 19 is continuous forming the rear edge 36 of the playing surface.

The first and second pin-high zones 22 and 26 therefore have only front to back lines 14*a* passing through them, while the in-line zone has only side to side lines 14*b* passing through it, and the second scoring zones 28 have both side to side lines 14*b* and front to back lines 14*a* passing through them.

A semicircular line 62 is found to the front of the circular outline 19 and is spaced 20 mm from the circular outline 19. This line bounds the front of the holded-out zone 20.

Each one of the plurality of scoring indices 16 comprises a number indicating a score which is associated with a respective one of the plurality of spaced apart lines 14.

Each number represents a negative value and is assigned to the associated line at a location in an appropriate area such that it is easy to distinguish the values of the lines at a glance. The lines 44, 45 and 46, 47 lying closest to the circular outline 19 are assigned a value of negative one (−1). The value of the lines become increasingly negative as they progress outwards from the circular outline 19 to the respective outward most lines defining the sides 36, 38, 40 and 42. Each outward most line 36, 38, 40 and 42 is assigned the value negative ten (−10). The semicircular line 62 is assigned the value of negative one (−1). Other appropriate values may be assigned to the lines in alternative arrangements.

In use the scoring template 12 is placed on a suitable putting surface, such as carpet, grass green, or the like. Each player starts the game with the same predetermined score (e.g. 0, 10, 50, 100, etc.). Each player then putts a ball 30 onto the scoring template 12 from a position a distance in front of the scoring template 12. The distance from which the player will putt is determined according to the player's putting skill level. The player putts a number of times calculating the score after each putt.

The golf ball 30 is putted with the intention of having it come to rest past the semicircular line 62 and within the circular zone 18 or the holed-out zone 20. If the golf ball 30 comes to rest past the semicircular line 62 the golf ball 30 is deemed to have fallen into the 'hole'. If the golf ball 30 comes to rest just past the semicircular line 62 and overlaps the outer edge of the circular outline 19, the golf ball 30 is deemed to be holed because the distance from the semicircular line 62 to the circular outline 19 is less than the radius of the golf ball 30.

If the golf ball 30 comes to rest within the circular zone 18 the current score is obtained by adding the number indicated by the scoring indicia in the circular zone to the previous score.

If the golf ball 30 comes to rest on the holed-out zone 20 the current score is obtained by adding the number indicated by the scoring indicia in the holed-out zone to the previous score.

If the golf ball 30 comes to rest on the in-line zone 24 the current score is obtained by adding the number indicated by the scoring indicia of the outer most side to side line 14*b* lying adjacent the golf ball 30 to the previous score.

If the golf ball 30 comes to rest on the first and second pin-high zones 22 and 26, the current score is obtained by adding the number indicated by the scoring indicia of the outer most front to back line 14*a* lying adjacent the golf ball 30 to the previous score.

If the golf ball 30 comes to rest on one of the second scoring zones 28 the current score is obtained by adding the numbers indicated by the scoring indices on the outermost two intersecting lines 14*a* and 14*b* lying adjacent the golf ball 30 to the previous score. Alternatively this rule may be changed to adding the value of the innermost lines thereby favoring the player.

If the golf ball 30 comes to rest off the scoring template 12, a penalty is added to the previous score to determine the current score. This includes balls 30 which pass over the circular zone 18 and roll off the scoring template 12. These are deemed to have been traveling too fast and would have skipped over the 'hole'.

There are many alternative methods of using the scoring template, a few of which are listed below:

a) For single player use: the player may putt one ball a number of times from a set distance or varied distances, (e.g. 10 times) with the sum of the values for each putt being deducted from a predetermined starting score (e.g. 100).

b) For single player use: the player may putt a number of balls from a set distance or varied distances and obtain a score.

c) Players may play against each other.

d) Players may form teams against each other.

e) Players may place the scoring template on a grass putting green placing the actual hole beneath the circular zone.

f) Players may place the scoring template on an uneven putting surface (e.g. sloping grass putting green) making the game more challenging. Other suitable uneven surfaces may be constructed.

g) Players may putt with different colored balls where striking an opponent's ball off of the scoring template with their own in the intention.

h) Players may putt ten numbered balls (e.g. 1 to 10) in sequence attempting to get all ten balls come to rest in the circular zone and holed-out zone such that no ball overtakes or overlaps the previously putted ball.

In an alternative arrangement the scoring template may be permanently printed, painted, stenciled or the like onto a suitable putting surface such as carpet, grass greens, or sheet material. If the putting surface is a carpet or like material an appropriate approach area of sufficient length must be added along which a player may putt.

In a second alternative embodiment the scoring template 12 is circular with the circular zone 18 arranged at the geometric centre 34 of a plurality of concentric circles 72. The scoring template 12 has a playing surface having a total diameter of 916.06 mm and the circular zone 18 has a diameter of 108 mm and is defined by a circular outline 19. A first one of the concentric circles 68 is spaced a distance 58 (20 mm) outwards from the circular outline 19. Each one of the additional concentric circles 72 is spaced a second distance 74 (42.67 mm) outwards from each inwardly adjacent circle. The holed-out zone 20 extends from the circular outline 19 to a rear portion of the peripheral edge 76 of the scoring template 12.

In use the alternative circular embodiment is used in a manner similar to the rectangular embodiment with the exception that when the golf ball 30 comes to rest between two of the plurality of spaced apart circular lines the current score is obtained by adding the number indicated by the scoring indicia 16 of the outer most line 72 lying adjacent the golf ball 30 to the previous score.

While one embodiment of the present invention has been described in the foregoing, it is to be understood that other embodiments are possible within the scope of the invention. The invention is to be considered limited solely by the scope of the appended claims.

I claim:

1. A golf putting game apparatus for putting on a putting surface with a ball having a predetermined diameter, said apparatus comprising:

a scoring template to be placed on the putting surface, said template having opposite front and rear edges and including:

hole marking means for marking on the putting surface a circular zone having a diameter greater than the predetermined diameter of the ball, said circular zone representing a hole on a golf green;

holed-out zone marking means for marking on the putting surface an elongate holed-out zone extending from the circular zone to the rear edge of the template, the holed-out zone being spaced from opposite sides of the circular zone a distance less than one half the predetermined diameter of the ball;

scoring zone marking means for marking on the putting surface a pattern of spaced apart lines, said scoring zone marking means being spaced from and extending outwards from the circular zone to the edges of the template.

2. A golf putting game apparatus in accordance with claim 1 wherein the template is rectangular and has opposite side edges and the pattern marked on the putting surface by the scoring zone marking means is substantially rectangular in shape.

3. A golf putting game apparatus in accordance with claim 2 wherein the scoring zone marking means includes means marking on the putting surface two elongate pin-high zones extending outwards from the circular zone towards respective side edges of the templates, each one of said plurality of elongate pin-high zones being spaced from opposite sides of the circular zone a distance less than one half the predetermined diameter of the ball.

4. A golf putting game apparatus in accordance with claim 3 wherein the scoring zone marking means includes means marking on the putting surface an on-line zone extending from the circular zone to the front side edge, the on-line zone being aligned with the holed-out zone.

5. A golf putting game apparatus in accordance with claim 1 wherein the template is substantially circular in shape and the pattern marked on the putting surface by the scoring zone marking means comprises means marking on the putting surface a plurality of circular arcs concentric with the circular zone.

6. A golf putting game apparatus in accordance with claim 1 wherein the hole marking means, the holed-out zone marking means and the scoring zone marking means comprise a plurality of elongate members interconnected in a net.

* * * * *